US005572089A

United States Patent [19]

Kyushima et al.

[11] Patent Number: 5,572,089

[45] **Date of Patent: *Nov. 5, 1996**

[54] PHOTOMULTIPLIER FOR MULTIPLYING PHOTOELECTRONS EMITTED FROM A PHOTOCATHODE

[75] Inventors: Hiroyuki Kyushima; Koji Nagura; Yutaka Hasegawa; Eiichiro Kawano; Tomihiko Kuroyanagi; Akira Atsumi; Masuya Mizuide, all of Hamamatsu, Japan

[73] Assignee: Hamamatsu Photonics K.K., Hamamatsu, Japan

[ * ] Notice: The term of this patent shall not extend beyond the expiration date of Pat. No. 5,498,926.

[21] Appl. No.: 234,153

[22] Filed: Apr. 28, 1994

[30] Foreign Application Priority Data

| | | | |
|---|---|---|---|
| Apr. 28, 1993 | [JP] | Japan | 5-102898 |
| Apr. 28, 1993 | [JP] | Japan | 5-102902 |
| Apr. 28, 1993 | [JP] | Japan | 5-102910 |
| Apr. 30, 1993 | [JP] | Japan | 5-104668 |

[51] Int. Cl.[6] ..... H01J 43/22; H01J 43/04

[52] U.S. Cl. ..... 313/533; 313/532; 313/103 CM; 313/105 CM

[58] Field of Search ..... 313/532, 533, 313/534, 535, 536, 537, 540, 541, 542, 544, 103 R, 103 CM, 105 R, 105 CM; 250/214 VT

[56] References Cited

U.S. PATENT DOCUMENTS 4,649,314 3/1987 Eschard .

4,999,540 3/1991 L'hermite ..... 313/105 CM

FOREIGN PATENT DOCUMENTS

| | | |
|---|---|---|
| 2481004 | 10/1981 | France . |
| 1539957 | 10/1969 | Germany . |
| 51-43068 | 4/1976 | Japan . |
| 3147240 | 6/1991 | Japan . |
| 1405256 | 9/1975 | United Kingdom . |

OTHER PUBLICATIONS

Doulot et al, "Multianode Photomultiplier for Detection and Localization of Low Light Level Events", Paper Presented at Nuclear Science Symposium, Washington, Oct. 1986.

*Primary Examiner*—Nimeshkumar Patel
*Attorney, Agent, or Firm*—Cushman Darby & Cushman, L.L.P.

[57] ABSTRACT

A photomultiplier includes a photocathode and an electron multiplier. A typical structure of the electron multiplier is obtained such that a dynode unit constituted by stacking a plurality of dynode plates in the incident direction of photoelectrons, an anode plate, and an inverting dynode plate are stacked. The anode plate has electron through holes at a predetermined portion to cause secondary electrons emitted from the dynode unit to pass therethrough. Each electron through hole has a diameter on the inverting dynode plate side larger than that on the dynode unit side, thereby increasing the capture area of the secondary electrons orbit-inverted by the inverting dynode plate.

28 Claims, 6 Drawing Sheets

PHOTOMULTIPLIER FOR MULTIPLYING PHOTOELECTRONS EMITTED FROM A PHOTOCATHODE

BACKGROUND OF THE INVENTION

1. Field of the Invention

The present invention relates to a photomultiplier for multiplying photoelectrons emitted from a photocathode in correspondence with incident light by multilayered dynodes.

2. Related Background Art

Conventionally, photomultipliers have been widely used for various measurement devices in nuclear medicine and high-energy physics such as a γ-camera, PET (Positron Emission Tomography), or calorimeter.

A conventional electron multiplier includes a photomultiplier having a photocathode. This electron multiplier includes an anode and a dynode unit formed by stacking a plurality of stages of dynodes in the incident direction of an electron flow in a vacuum container.

SUMMARY OF THE INVENTION

A photomultiplier according to the present invention comprises an anode, a diode unit obtained by stacking N stages of dynodes, and inverting dynodes. These members are disposed on a base member of a vacuum container. In the general manufacture of a photomultiplier, when the interior of the vacuum container is to be set in a vacuum state and an alkali metal vapor is to be introduced from the base member to deposit and activate the photoelectric surface of a photocathode and the secondary electron emitting layer of each dynode, the alkali metal vapor flows from the peripheral portions of the photocathode and each dynode to the central portions thereof to deposit the photoelectric surface and the secondary electron emitting layer. For this reason, if a means for passing the metal vapor is not arranged near the inverting dynode, the thicknesses of the alkali metal layers at the central portions of the photocathode and each dynode are smaller than those at the peripheral portions. This causes large sensitivity variations depending on the positions of the photoelectric surface on which light is incident.

Assume that the electron capture area of the anode exposed with respect to the dynodes is small at the position where the secondary electrons emitted from the last-stage dynodes of the dynode unit reach. In this case, the field intensity at the anode is reduced, and the space charge is highly generated at this position. Therefore, the secondary electrons captured by the anode are reduced, and therefore a large pulse output proportional to the energy of incident light cannot be obtained.

It is one of the objects of the present invention to provide a photomultiplier capable of obtaining a uniform sensitivity with respect to the positions of a photoelectric surface and an output pulse proportional to the energy of incident light.

A photomultiplier according to the present invention is formed by a photocathode and an electron multiplier including an anode and a dynode unit arranged between the photocathode and the anode.

The electron multiplier is mounted on a base member and arranged in a housing formed integral with the base member for fabricating a vacuum container. The photocathode is arranged inside the housing and deposited on the surface of a light receiving plate provided to the housing. At least one anode is supported by an anode plate and arranged between the dynode unit and the base member. The dynode unit is formed by stacking a plurality of stages of dynode plates for respectively supporting at least one dynode for receiving and cascade-multiplying photoelectrons emitted from the photocathode in an incidence direction of the photoelectrons.

The housing may have on an inner wall thereof deposited a conductive metal for applying a predetermined voltage to the photocathode and rendered conductive by a predetermined conductive metal to equalize the potentials of the housing and tile photocathode.

The photomultiplier according to the present invention has at least one focusing electrode between the dynode unit and the photocathode. The focusing electrode is supported by a focusing electrode prate. The focusing electrode plate is fixed on the electron incident side of the dynode unit through insulating members. The focusing electrode plate has holding springs and at least one contact terminal, all of which are integrally formed with this plate. The holding springs are in contact with the inner wall of the housing to hold the arrangement position of the dynode unit fixed on the focusing electrode plate through the insulating members. The contact terminal is in contact with the photocathode to equalize the potentials of the focusing electrodes and the photocathode. The contact terminal functions as a spring.

The focusing electrode plate is engaged with connecting pins, guided into the vacuum container, for applying a predetermined voltage to set a desired potential. For this purpose, an engaging member engaged with the corresponding connecting pin is provided at a predetermined position of a side surface of the focusing electrode plate. The side surface means is a surface parallel to the incident direction of the photoelectrons.

A plurality of anodes may be provided to the anode plate, and electron passage holes through which secondary electrons pass are formed in the anode plate correspondence with positions where the secondary electrons emitted from the last-stage of the dynode unit reach. Therefore, the photomultiplier has, between the anode plate and the base member, an inverting dynode plate for supporting at least one inverting dynode in parallel to the anode plate. The inverting dynode plate inverts the orbits of the secondary electrons passing through the anode plate toward the anodes. The diameter of the electron incident port (dynode unit side of the electron passage hole formed in the anode plate smaller than that of the electron exit port (inverting dynode plate side). The inverting dynode plate has, at positions opposing the anodes, a plurality of through holes for injecting a metal vapor to form at least a secondary electron emitting layer on the surface of each-stage dynode of the dynode unit, and the photocathode.

The through holes formed in the inverting dynode plate to inject a metal vapor may be formed as follows. The through holes positioned at the center of the inverting dynode plate may have a larger diameter than these holes positioned at the periphery of the inverting dynode plate to improve the injection efficiency of the metal vapor. Of the through holes formed in the inverting dynode plate to inject a metal vapor, the through holes positioned adjacent to each other at the center of the inverting dynode plate may have an interval therebetween smaller than that between the through holes positioned adjacent to each other at the periphery of the inverting dynode plate.

The potential of the inverting dynode plate must be set lower than that of the anode plate to invert the orbits of secondary electrons passing through the through holes of the anode plate. For this purpose, an engaging member engaged with the corresponding connecting pin, guided into the vacuum container, for applying a desired voltage is provided at a predetermined position of the side surface of the inverting dynode plane. A similar engaging member is also provided to a predetermined portion of the anode plate.

In particular, a surface opposed parallel to the inverting dynode plate is formed inside an electron passage hole formed in the anode plate. The inverting dynode plate functions to invert orbits of the secondary electrons passing through the electron passage holes toward the anode plate. In this manner, the structure of the electron passage boles of the anode plates is given as a structure in which the secondary electron capture area is increased. As compared with holes having a predetermined diameter, the secondary electrons can be captured with a higher efficiency, and an output pulse proportional to the intensity of the incident light can be obtained.

On the other hand, the photomultiplier according to the present invention may have, between the inverting dynode plate and the base member, a shield electrode plate for supporting at least one shield electrode in parallel to the inverting dynode plate. The shield electrode plate inverts the orbits of the secondary electrons passing through the anode plate toward the anodes. The shield electrode plate has a plurality of through holes for injecting a metal vapor to form at least a secondary electron emitting layer on the surface of each dynode of the dynode unit. In place of this shield electrode plate, a surface portion of the base member opposing the anode plate may be used as an electrode and substituted for the shield electrode plate.

The potential of the shield electrode plate must also be set lower than that of the anode plate to invert, toward the anode, the orbits of the secondary electrons passing through the through holes of the anode plate. Thus, an engaging member engaged with the corresponding connecting pin, guided into the vacuum container, for applying a desired voltage is also provided at a predetermined position of the side surface of the shield electrode plate.

In particular, the electron multiplier comprises a dynode unit including a plurality of stacked stages of dynode plates, the dynode plates spaced apart from each other at predetermined intervals through insulating members in an incidence direction of the electron flow, for respectively supporting at least one dynode for cascade-multiplying an incident electron flow, and an anode plate opposing the last-stage dynode plate of the dynode unit through insulating members. Each plate described above, such as the dynode plate, has a first concave portion for arranging a first insulating member which is provided on the first main surface of the dynode plate and partially in contact with the first concave portion and a second concave portion for arranging a second insulating member which is provided on the second main surface of the dynode plate and partially in contact with the second concave portion (the second concave portion communicates with the first concave portion through a through hole). The first insulating member arranged on the first concave portion and the second insulating member arranged on the second concave portion are in contact with each other in the through hole. An interval between the contact portion between the first concave portion and the first insulating member and the contact portion between the second concave portion and the second insulating member is smaller than that between the first and second main surfaces of the dynode plate. The above concave portion can be provided in the anode plate, the focusing plate, inverting dynode plate and the shield electrode plate.

Important points to be noted in the above structure will be listed below. The first point is that gaps are formed between the surface of the first insulating member and the main surface of the first concave portion and between the second insulating member and the main surface of the second concave portion, respectively, to prevent discharge between the dynode plates. The second point is that the central point of the first insulating member, the central point of the second insulating member, and the contact point between the first and second insulating members are aligned on the same line in the stacking direction of the dynode plates so that the intervals between the dynode plates can be sufficiently kept.

Using spherical or circularly cylindrical bodies as the first and second insulating members, the photomultiplier can be easily manufactured. When circularly cylindrical bodies are used, the outer surfaces of these bodies are brought into contact with each other. The shape of an insulating member is not limited to this. For example, an insulating member having an elliptical or polygonal section can also be used as long as the object of the present invention can be achieved.

In this electron multiplier, each plate described above, such as the dynode plate, has an engaging member at a predetermined position of a side surface of the plate to engage with a corresponding connecting pin for applying a predetermined voltage. Therefore, the engaging member projects in a vertical direction to the incident direction of the photoelectrons. The engaging member includes a pair of guide pieces for guiding the connecting pin. On the other hand, a portion near the end portion of the connecting pin, which is brought into contact with the engaging member, may be formed of a metal material having a rigidity lower than that of the remaining portion.

Each dynode plate is constituted by at least two plates, each having at least one opening for forming as the dynode and integrally formed by welding such that the openings are matched with each other to function as the dynode when the two plates overlap. To integrally form these two plates by welding, each of the plates has at least one projecting piece for welding the corresponding two plates. The side surface of the plate is located parallel with respect to the incident direction of the photoelectrons.

According to the present invention, the inverting dynode plate is disposed parallel to the dynode plates below (base member side) the anode plate. This inverting dynode plate has through holes arranged at a pitch equal to that of the electron multiplication holes (portions serving as dynodes) of the dynodes. For this reason, when the alkali metal vapor is to be introduced in the vacuum tube to deposit and activate the photoelectric surface of a photocathode and the secondary electron emitting layer of each dynode, the alkali metal vapor is introduced from the bottom portion of the vacuum tube and passed through the through holes of the inverting dynode plate, the electron passage holes of the anode plate, the electron multiplication holes of each dynode plate, and the through holes (corresponding to the focusing electrodes) of the focusing plate. The alkali metal vapor can be almost uniformly deposited on the surfaces of each dynode and the photocathode from the central portions to the peripheral portions thereof. Therefore, the uniform reactivity for generation of the photoelectrons and emission of the secondary electrons is obtained at each position of the photocathode and each dynode. Therefore, the sensitivity variations depending on the positions of the photocathode on which light is incident can be reduced.

According to the present invention, the anode plate is disposed parallel to the dynode plates below (base member side) the dynode unit. This anode plate has a plurality of electron passage holes at positions where the secondary electrons emitted from the dynode unit reach. The inverting dynode plate is disposed parallel to the dynode plates below (base member side) the anode plate. This inverting dynode plate has a plurality of through holes between (positions opposing the anodes) a plurality of positions where the secondary electrons passing through the electron through holes of the anode plate reach. For this reason, the secondary electrons emitted from the dynodes except for the last-stage dynode plate highly efficiently pass through the electron passage holes of the anode plate, and the orbits of these secondary electrons are inverted from the inverting dynode plate to the anode plate. The anode plate sandwiched between the last-stage dynode plate of the dynode unit and the inverting dynode plate has an exposure area larger than that of each dynode plate. In addition, each electron passage hole of the anode plate has an input opening smaller than an output opening opposing the inverting dynode plate. For this reason, the field intensity at each anode of the anode plate increases, and the space charge at each electron passage hole can be reduced. The electron capture area of each anode for the secondary electrons orbit-inverted by the inverting dynode plate is increased, so that the electrons captured by each anode can be increased. Therefore, the electrons emitted from the last-stage dynode plate and the inverting dynode plate are captured by each anode with a high efficiency, and an output pulse proportional to the energy of incident light can be obtained.

The contact portion between the insulating member and the concave portion is positioned in the direction of thickness of the dynode plate rather than the main surface of the dynode plate having the concave portion. Therefore, the intervals between the dynode plates can be substantially increased (FIGS. 12 and 13).

Discharge between the dynode plates is often caused due to dust or the like deposited on the surface of the insulating member. However, in the structure according to the present invention, intervals between the dynode plates are substantially increased, thereby obtaining a structure effective to prevent the discharge.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

An embodiment of the present invention will be described below with reference to FIGS. 1 to 11.

Figure 1:
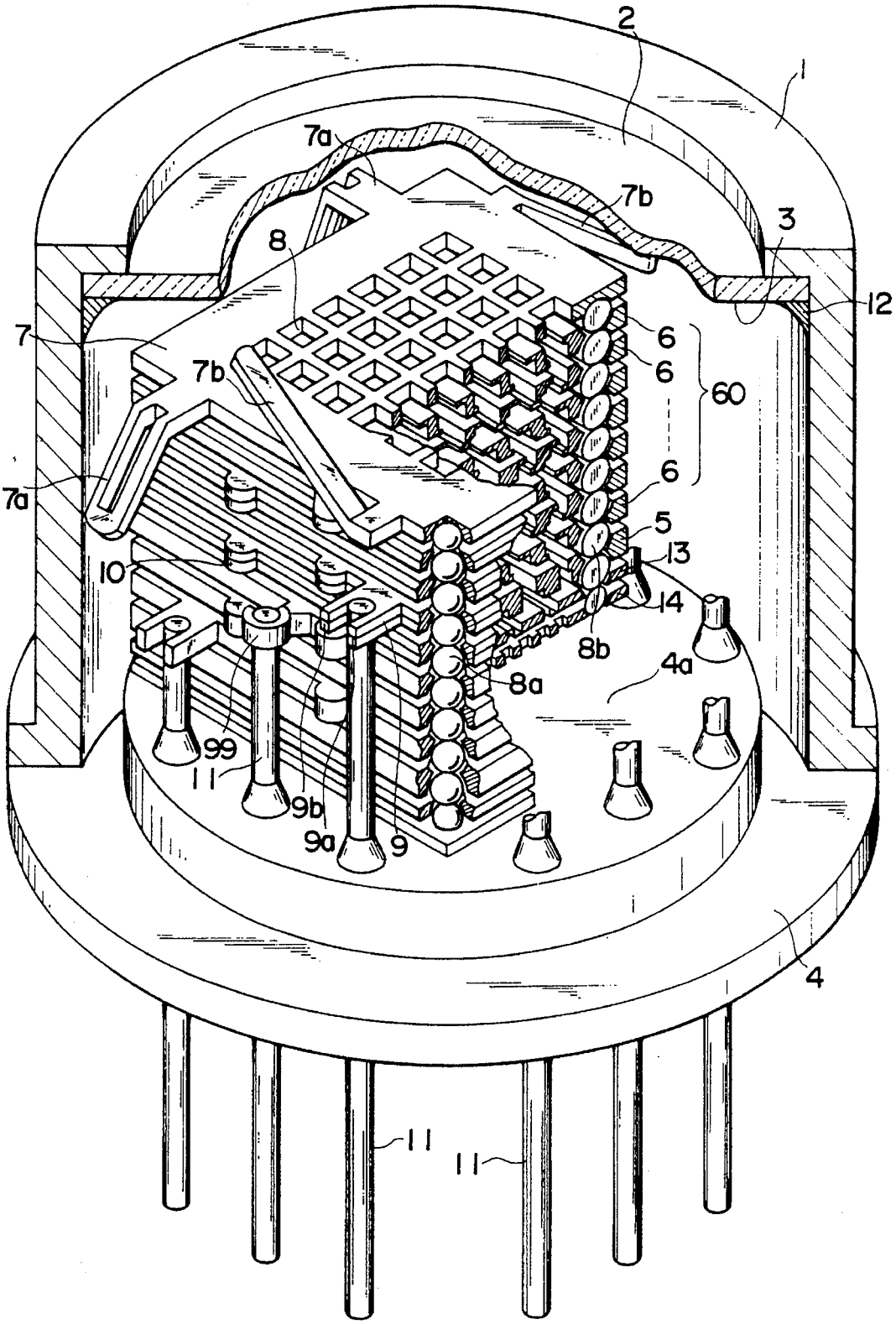
FIG. 1 is a partial sectional perspective view showing the overall structure of a photomultiplier according to the present invention.

FIG. 1 is a perspective view showing the entire structure of a photomultiplier according to the present invention. Referring to FIG. 1, the photomultiplier is basically constituted by a photocathode 3 and an electron multiplier. The electron multiplier includes anodes (anode plate 5) and a dynode unit 60 arranged between the photocathode 3 and the anodes.

The electron multiplier is mounted on a base member 4 and arranged in a housing 1 which is formed integral with the base member 4 to fabricate a vacuum container. The photocathode 3 is arranged inside the housing 1 and deposited on the surface of a light receiving plate 2 provided on the housing 1. The anodes are supported by the anode plate 5 and arranged between the dynode unit 60 and the base member 4. The dynode unit 60 is constituted by stacking a plurality of stages of dynode plates 6, for respectively supporting a plurality of dynodes 603 (see FIG. 3) for receiving and cascade-multiplying photoelectrons emitted from the photocathode 3, in the incidence direction of the photoelectrons.

The photomultiplier also has focusing electrodes 8 between the dynode unit 60 and the photocathode 3 for correcting orbits of the photoelectrons emitted from the photocathode 3. These focusing electrodes 8 are supported by a focusing electrode plate 7. The focusing electrode plate 7 is fixed on the electron incidence side of the dynode unit 60 through insulating members 8*a* and 8*b*. The focusing electrode plate 7 has holding springs 7*a* and contact terminals 7*b*, all of which are integrally formed with this plate 7. The holding springs 7*a* are in contact with the inner wall of the housing 1 to hold the arrangement position of the dynode unit 60 fixed on the focusing electrode plate 7 through the insulating members 8*a* and 8*b*. The contact terminals 7*b* are in contact with the photocathode 3 to equalize the potentials of the focusing electrodes 8 and the photocathode 3 and function as springs. When the focusing electrode plate 7 has no contact terminal 7*b*, the housing 1 may have an inner wall thereof deposited a conductive metal for applying a desired voltage to the photocathode 3, and the contact portion between the housing 1 and the photocathode 3 may be rendered conductive by a predetermined conductive metal 12 to equalize the potentials of the housing 1 and the photocathode 3. Although both the contact terminals 7*b* and the conductive metal 12 are illustrated in FIG. 1, one structure can be selected and realized in an actual implementation.

This focusing electrode plate 7 is engaged with a connecting pin 11, guided into the vacuum container, for applying a desired voltage to set a desired potential. For this purpose, an engaging member 9 (or 99) engaged with the corresponding connecting pin 11 is provided at a predetermined position of a side surface of the focusing electrode plate 7. The engaging member 9 may be formed by a pair of guide pieces 9*a* and 9*b* for guiding the corresponding connecting pin 11.

The anode is supported by the anode plate 5. A plurality of anodes may be provided to this anode plate 5, and electron passage holes through which secondary electrons pass are formed in the anode plate 5 in correspondence with positions where the secondary electrons emitted from the last-stage dynode of the dynode unit 60 reach. Therefore, this photomultiplier has, between the anode plate 5 and the base member 4, an inverting dynode plate 13 for supporting inverting dynodes in parallel to the anode plate 5. The inverting dynode plate 13 inverts the orbits of the secondary electrons passing through the anode plate 5 toward the anodes. The diameter of the electron incident port (dynode unit 60 side) of the electron passage hole formed in the anode plate 5 is smaller than that of the electron exit port (inverting dynode plate 13 side). The inverting dynode plate 13 has, at positions opposing the anodes, a plurality of through holes for injecting a metal vapor to form a secondary electron emitting layer on the surface of each dynode 603 of the dynode unit 60.

The potential of the inverting dynode plate 13 must also be set lower than that of the anode plate 5 to invert, toward the anodes, the orbits of the secondary electrons passing through holes 501 (see FIG. 2) of the anode plate 5. Thus, the engaging member 9 (or 99) engaged with the corresponding connecting pin, guided into the vacuum container, for applying a predetermined voltage is provided at a predetermined position of the side surface of the inverting dynode plate 13. The similar engaging member 9 is also provided at a predetermined portion of the anode plate 5.

Figure 2:
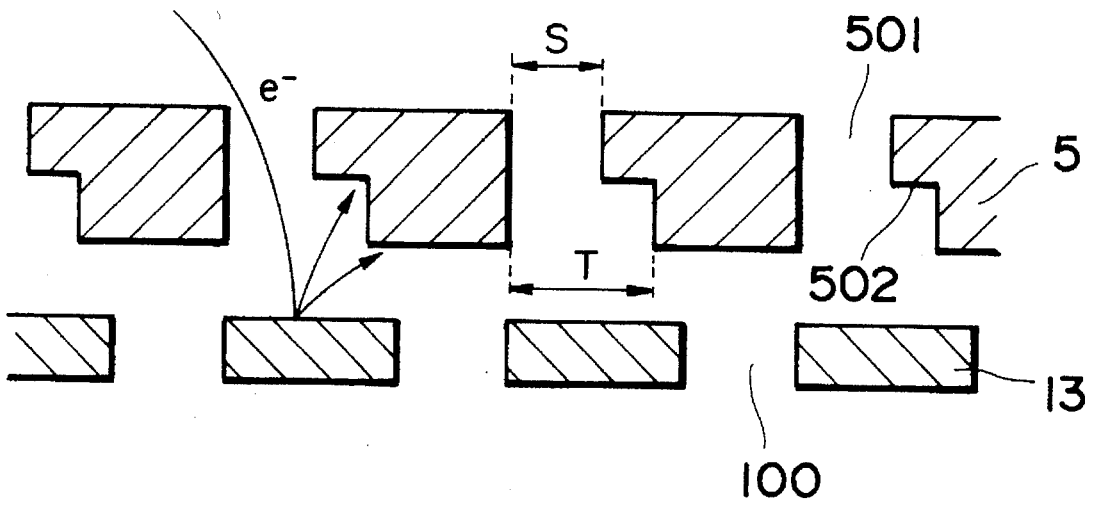
FIG. 2 is a sectional view showing the main part of an electron multiplier representing the structure of an anode plate of the photomultiplier according to the present invention.

FIG. 2 is a sectional view showing the main part of the electron multiplier in the photomultiplier shown in FIG. 1. As is apparent from FIG. 2, each electron passage hole 501 formed in the anode plate 5 has a secondary electron exit diameter (inverting dynode plate 13 side) T larger than a secondary electron incident diameter (dynode unit 60 side) S. A surface 502 opposing parallel to the inverting dynode plate 13 is formed inside the corresponding electron passage hole 501. The inverting dynode plate 13 has a function of inverting the orbits of the secondary electrons passing through the electron passage holes 501 toward the anode plate 5. In this manner, since the structure of each electron passage hole 501 of the anode plate 5 is given as a structure in which the secondary electron capture area is increased. As compared with electron passage holes having a predetermined diameter, the secondary electrons can be captured with a higher efficiency. At the same time, an output pulse proportional to the intensity of incident light can be obtained.

On the other hand, the photomultiplier may have, between the inverting dynode plate 13 and the base member 4, a shield electrode plate 14 for supporting shield electrodes in parallel to the inverting dynode plate 13. The shield electrode plate 14 inverts the orbits of the secondary electrons passing through the anode plate 5 toward the anodes. The shield electrode plate 14 has a plurality of through holes for injecting a metal vapor to form at least a secondary electron emitting layer on the surface of each dynode 603 of the dynode unit 60. In place of this shield electrode plate 14, a surface portion 4*a* of the base member 4 opposing the anode plate 5 may be used as a sealed electrode and substituted for the shield electrode plate 14.

As in the inverting dynode plate 13, the potential of the shield electrode plate 14 must also be set lower than that of the anode plate 5 to invert, toward the anodes, the orbits of the secondary electrons passing through the through holes 501 of the anode plate 5. Thus, the engaging member 9 engaged with the corresponding connecting pin 11, guided into the vacuum container, for applying a desired voltage is also provided at a predetermined position of the side surface of the shield electrode plate 14. The shield electrode plate 14 may have the same structure as that of the inverting dynode plate 13.

In particular, the electron multiplier comprises a dynode unit 60 constituted by stacking a plurality of stages of dynode plates 6, spaced apart from each other at predetermined intervals by the insulating members 8*a* and 8*b* in the incidence direction of the electron flow, and each dynode plate 6 is supporting a plurality of dynodes 603 for cascade-multiplying an incident electron flow, and the anode plate 5 opposing the last-stage dynode plate 6 of the dynode unit 60 through the insulating members 8*a* and 8*b*.

In this electron multiplier, each dynode plate 6 has an engaging member 9 at a predetermined position of a side surface of the plate to engage with a corresponding connecting pin 11 for applying a desired voltage. The side surface of the dynode plate 6 is in parallel with respect to the incident direction of the photoelectrons. The engaging member 9 is constituted by a pair of guide pieces 9*a* and 9*b* for guiding the connecting pin 11. The engaging member may have a hook-like structure (engaging member 99 illustrated in FIG. 1). The shape of this engaging member is not particularly limited as long as the connecting pin 11 is received and engaged with the engaging member. On the other hand, a portion near the end portion of the connecting pin 11, which is brought into contact with the engaging member 9, may be formed of a metal material having a rigidity lower than that of the remaining portion.

Each dynode plate 6 is constituted by two plates 6*a* and 6*b* having openings for forming the dynodes and integrally formed by welding such that the openings are matched with each other to function as dynodes when the two plate are overlapped each other. To integrally form the two plates 6*a* and 6*b* by welding, the two plates 6*a* and 6*b* have projecting pieces 10 for welding the corresponding projecting pieces thereof at predetermined positions matching when the two plates 6*a* and 6*b* are overlapped each other.

Figure 3:
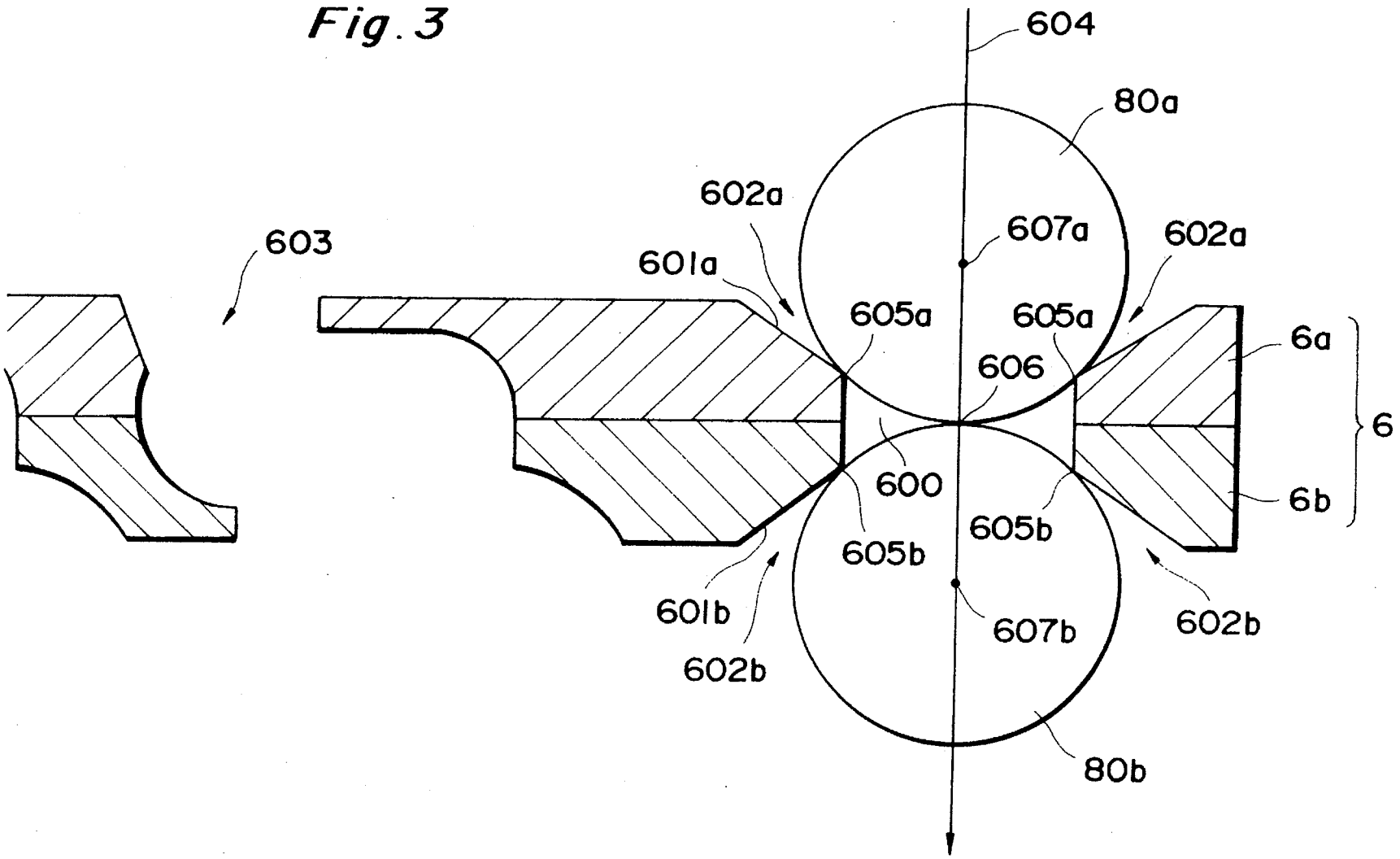
FIG. 3 is a sectional view showing a typical shape of a concave portion formed in a dynode plate in the photomultiplier according to the present invention.

The structure of each dynode plate 6 that makes up the dynode unit 60 will be described below. FIG. 3 is a sectional view showing the shape of each plate, such as the dynode plate 6. Referring to FIG. 3, the dynode plate 6 has a first concave portion 601*a* for arranging a first insulating member 80*a* which is provided on a first main surface of the dynode plate 6 and partially in contact with the first concave portion 601*a* and a second concave portion 601*b* for arranging a second insulating member 80*b* which is provided on a second main surface of the dynode plate 6 and partially in contact with the second concave portion 601*b* (the second concave portion 601*b* communicates with the first concave portion 601 through a through hole 600). The first insulating member 80*a* arranged on the first concave portion 601*a* and the second insulating member 80*b* arranged on the second concave portion 601*b* are in contact with each other in the through hole 600. An interval between the contact portion 605*a* between the first concave portion 601*a* and the first insulating member 80*a* and the contact portion 605*b* of the second concave portion 601*b* and the second insulating member 80*b* is smaller than that (thickness of the dynode plate 6) between the first and second main surfaces of the dynode plate 6.

Gaps 602*a* and 602*b* are formed between the surface of the first insulating member 80*a* and the main surface of the first concave portion 601*a* and between the second insulating member 80*b* and the main surface of the second concave portion 601*b*, respectively, to prevent discharge between the dynode plates 6. A central point 607*a* of the first insulating member 80*a*, a central point 607*b* of the second insulating member 80*b*, and a contact-point 606 between the first and second insulating members 80*a* and 80*b* are aligned on the same line 604 in the stacking direction of the dynode plates 6 so that the intervals between the dynode plates 6 can be sufficiently kept.

The photomultiplier according to the present invention has a structure in which the focusing electrode plate 7, dynode plates 6 for constituting a dynode unit 60, the anode plate 5, the inverting dynode plate 13, and the shield electrode plate 14 are sequentially stacked through insulating members in the incident direction of the photoelectrons emitted from the photocathode 3. Therefore, the above-described concave portions can be formed in the main surfaces of the plates 5, 6, 7, 13, and 14 to obtain a high structural strength and prevent discharge between the plates.

Using the spherical bodies 8*a* or circularly cylindrical bodies 8*b* as the first and second insulating members 80*a* and 80*b* (insulating members 8*a* and 8*b* in FIG. 1), the photomultiplier can De easily manufactured. When circularly cylindrical bodies are used, the side surfaces of the circularly cylindrical bodies are brought into contact with each other. The shape of the insulating member is not limited to this. For example, an insulating member having an elliptical or polygonal section can also be used as long as the object of the present invention can be achieved. Referring to FIG. 3, reference numeral 603 denotes a dynode. A secondary electron emitting layer containing an alkali metal is formed on the surface of this dynode.

The shapes of the concave portion formed on the main surface of the plate 5, 6, 7, 13, or 14 will be described below with reference to FIGS. 4 to 7. For the sake of descriptive convenience, only the first main surface of the dynode plate 6 is disclosed in FIGS. 4 to 7. In these plates, the concave portion may be formed only in one main surface if there is no structural necessity.

Figure 4:
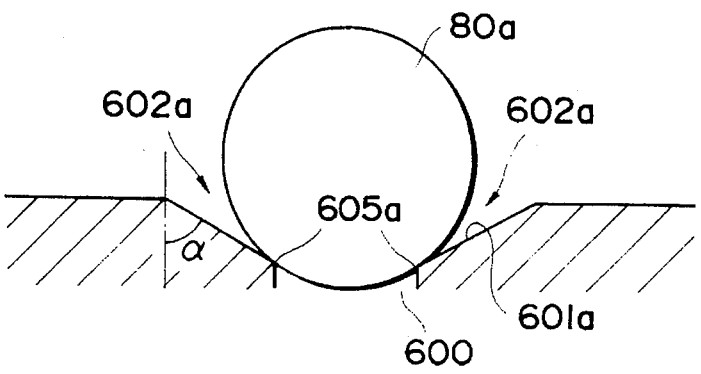
FIG. 4 is a sectional view showing the shape of the concave portion as a first application of the concave portion shown in FIG. 3.

The first concave portion 601a is generally formed by a surface having a predetermined taper angle (α) with respect to the direction of thickness of the dynode plate 6, as shown in FIG. 4.

Figure 5:
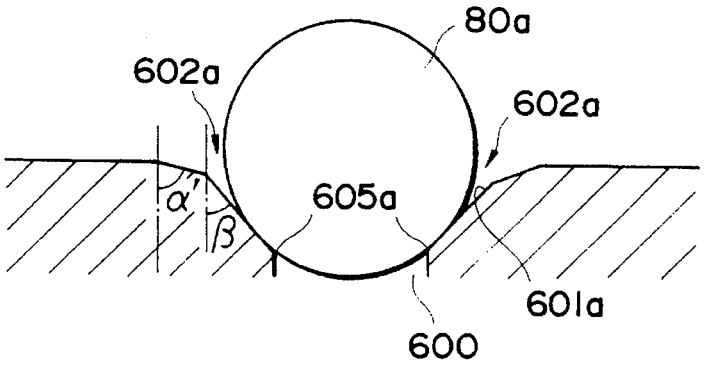
FIG. 5 is a sectional view showing the shape of the concave portion as a second application of the concave portion shown in FIG. 3.

This first concave portion 601*a* may be formed by a plurality of surfaces having predetermined taper angles (α and β) with respect to the direction of thickness of the dynode plate 6, as shown in FIG. 5.

Figure 6:
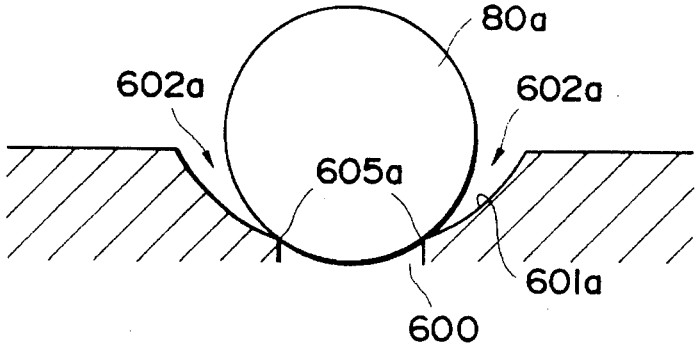
FIG. 6 is a sectional view showing the shape of the concave portion as a third application of the concave portion shown in FIG. 3.

The surface of the first concave portion 601*a* may be a curved surface having a predetermined curvature, as shown in FIG. 6. The curvature of the surface of the first concave portion 601*a* is set smaller than that of the first insulating member 80*a*, thereby forming the gap 602*a* between the surface of the first concave portion 601*a* and the surface of the first insulating member 80*a*.

Figure 7:
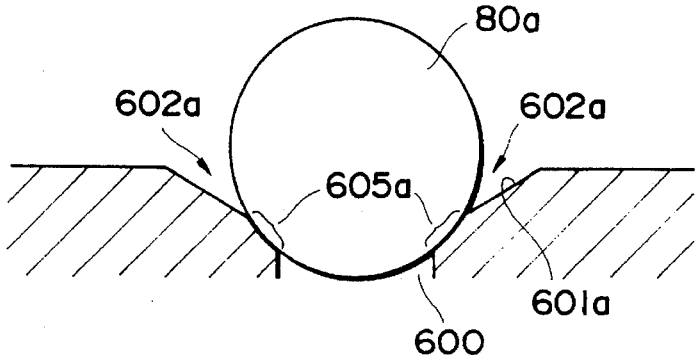
FIG. 7 is a sectional view showing the shape of the concave portion as a fourth application of the concave portion shown in FIG. 3.

To obtain a stable contact state with respect to the first insulating member 80*a*, a surface to be brought into contact with the first insulating member 80*a* may be provided to the first concave portion 601*a*, as shown in FIG. 7. In this embodiment, a structure having a high mechanical strength against a pressure in the direction of thickness of the dynode plate 6 even compared to the above-described structures in FIGS. 4 to 6 can be obtained.

Figure 8:
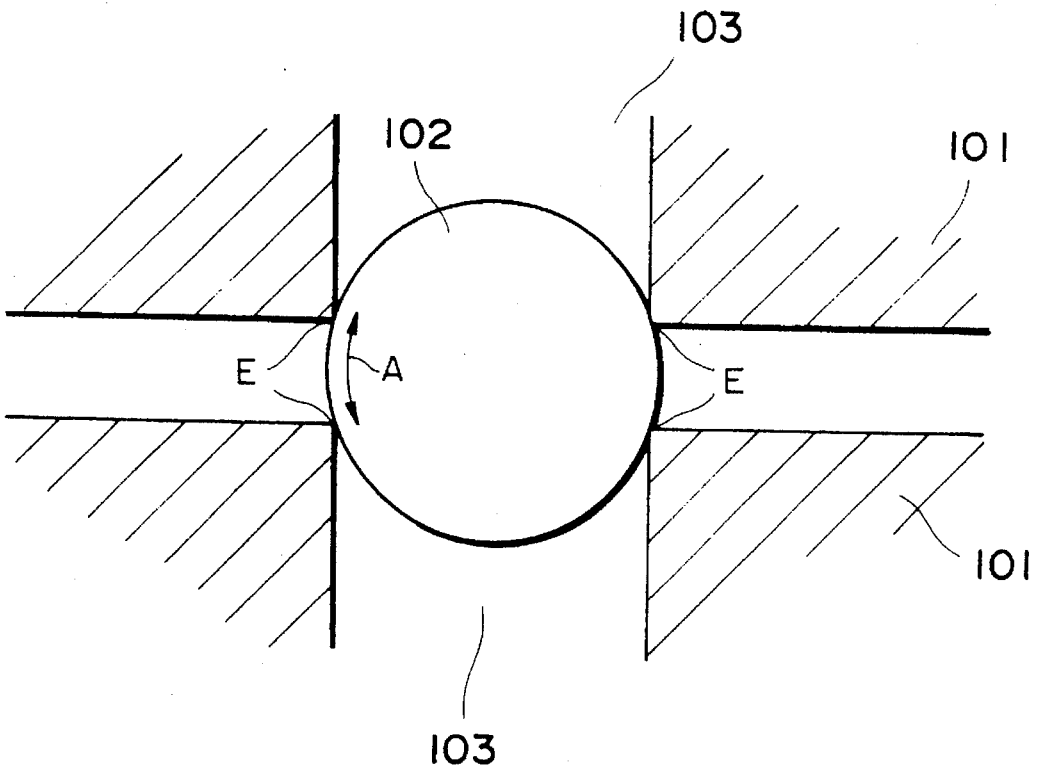
FIG. 8 is a sectional view showing the structure between the dynodes and the support in a conventional photomultiplier as a comparative example so as to explain the effect of the present invention.
Figure 9:
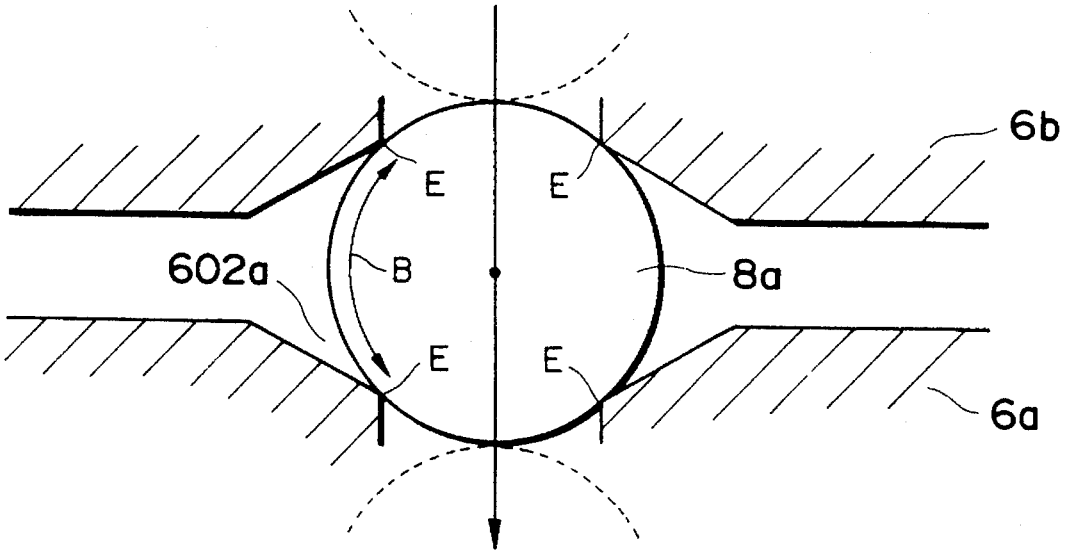
FIG. 9 is a sectional view showing the structure between dynode plates so as to explain the effect of the present invention.

The detailed structure between the dynode plates 6, adjacent to each other, of the dynode unit 60 will be described below with reference to FIGS. 8 and 9. FIG. 8 is a partial sectional view showing the conventional photomultiplier as a comparative example of the present invention. FIG. 9 is a partial sectional view showing the photomultiplier according to an embodiment of the present invention.

In the comparative example shown in FIG. 8, the interval between the support plates 101 having no concave portion is almost the same as a distance A (between contact portions E between the support plates 101 and the insulating member 102) along the surface of the insulating member 102.

On the other hand, in an embodiment of the present invention shown in FIG. 9, since concave portions are formed, a distance B (between the contact portions E between the plates 6*a* and 6*b* and the insulating member along the surface of the insulating member 8*a* is larger than the interval between plates 6*a* and 6*b*. Generally, discharge between the plates 6*a* and 6*b* is assumed to be caused along the surface of the insulating member 8*a* due to dust or the like deposited on the surface of the insulating member 8*a*. Therefore, as shown in this embodiment (see FIG. 9), when the concave portions are formed, the distance B along the surface of the insulating member 8*a* substantially increases as compared to the interval between the plates 6*a* and 6*b*, thereby preventing discharge which occurs when the insulating member 8*a* is inserted between the plates 6*a* and 6*b*.

The detailed structures of the photomultiplier according to the present invention will be described with reference to FIGS. 10 and 11.

Figure 10:
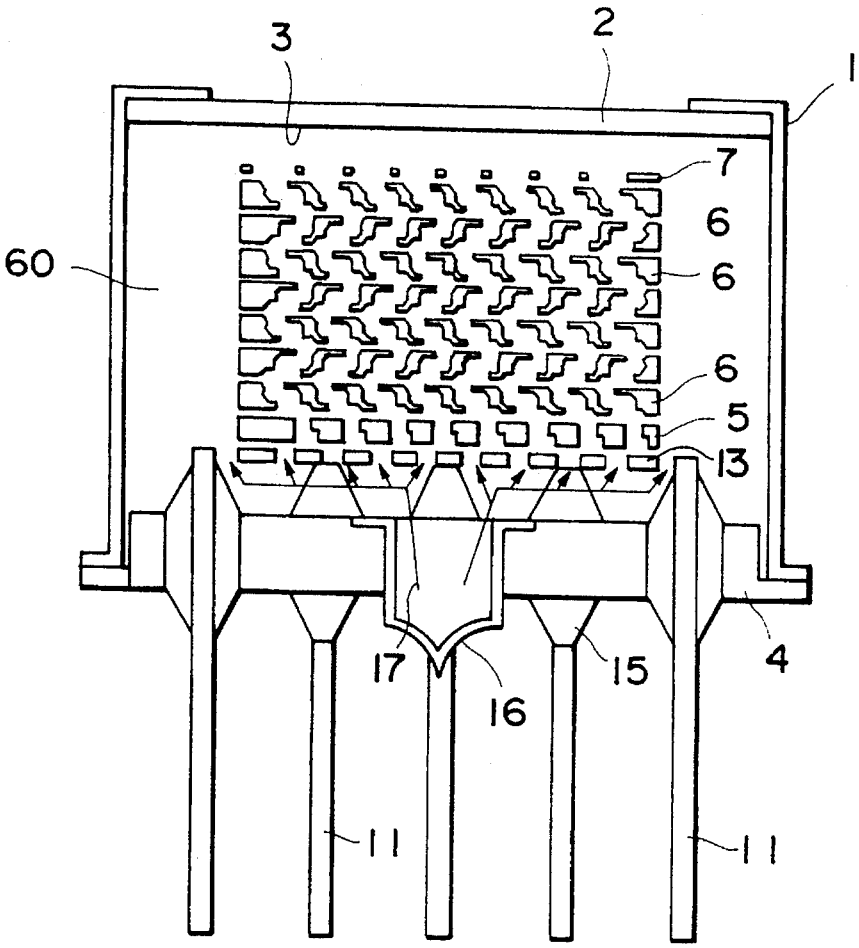
FIG. 10 is a side sectional view showing the internal structure of the photomultiplier according to the present invention.
Figure 11:
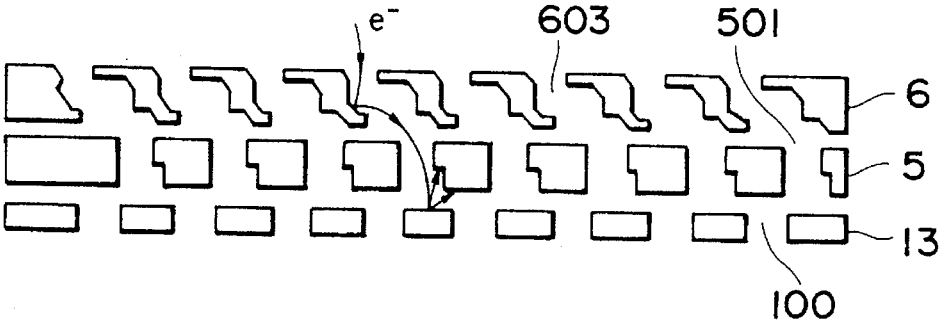
FIG. 11 is a sectional view showing the main part of an electron multiplier in the photomultiplier according to the present invention.

FIG. 10 is a sectional view showing the structure of the photomultiplier shown in FIG. 1. FIG. 11 is a sectional view showing the main part of the photomultiplier shown in FIG. 1. This photomultiplier comprises a circular light receiving plate 2 for receiving incident light, a cylindrical metal side plate 1 (housing) located at the circumference of the light receiving plate 2, and a circular metal base 4 constituting a base member. These members are disposed in a vacuum container. An electron multiplier for cascade-multiplying an incident electron flow is disposed inside the vacuum container.

Each connecting pin 11 connected to an external voltage terminal to apply a desired voltage to each dynode plate 6 of the dynode unit 60 extends through a metal base 4. Each connecting pin 11 is fixed to the metal base 4 through hermetic glass 15 tapered from the surface of the metal base 4 along the connecting pin 11. Note that a metal tip tube 16 whose terminal end is compression-bonded and sealed extends downward (outside the vacuum container) at the center of the metal base 4. This metal tip tube 16 is used to introduce an alkali metal vapor flow 17 to the vacuum container and exhaust the gas left in the vacuum container. After the metal tip tube 16 is used, it is sealed, as shown in FIG. 10. The hermetic glass 15 is tapered along the connecting pin 11 in consideration of a breakdown voltage and a leakage current.

On the lower surface of the light receiving plate 2, after MnO or Cr is vacuum-deposited, Sb is deposited, and an alkali metal such as K or Cs is then formed and activated to form a photocathode 3. The potential of this photocathode 3 is held at 0 V.

A focusing electrode plate 7 formed of a stainless plate is disposed between the photocathode 3 and the dynode unit 60. This focusing electrode plate 7 has a large number of through holes (corresponding to focusing electrodes 8) arranged at a predetermined pitch in a matrix form. This focusing electrode plate 7 is set at a predetermined potential, e.g., 0 V. Therefore, the orbits of the photoelectrons emitted from the photocathode 3 are adjusted by the influence of the focusing electrodes 8. The photoelectrons are incident on a predetermined area (first-stage dynode plate 6) of the dynode unit 60.

The dynode unit 60 is formed by stacking N (e.g., seven) stages of dynode plates 6 each having a square, flat shape. Note that N is an arbitrary natural number. Each dynode plate 6 has a plurality of electron multiplication holes (dynodes 603) having a conductive surface, formed by etching, and extending in the thickness direction. These electron multiplication holes are arranged in each dynode plate 6 at a predetermined pitch in the matrix form. An input opening serving as one end of each electron multiplication hole is formed in the upper surface (photocathode 3 side) of this plate, and an output opening serving as the other end of the corresponding electron multiplication hole is formed in the lower surface (anode plate 5 side). Each electron multiplication hole is enlarged toward the output opening having a larger diameter than that of the input opening, so that the surface of the inclined portion thereof is constituted by a curved surface. Sb is deposited and an alkali metal compound as of K or Cs is reacted with Sb to form a secondary electron emitting layer. This secondary electron emitting layer is formed on the surface of the inclined portion against which the electrons incident from the input opening are bombarded. The adjacent dynode plates 6 have a potential difference for forming a damping electric field for guiding the secondary electrons emitted from each upper dynode toward the adjacent lower dynode. The potential is increased every 100 V from the upper-stage dynodes to the lower-stage dynodes.

The anode plate 5 and the inverting diode plate 13 are sequentially disposed below (metal base 4 side) the last-stage dynode plate 6 of the dynode unit 60. The anode plate 5 has a plurality of electron passage holes 501 formed by etching or the like and extending through the direction of thickness. The arrangement pitch of the electron passage holes 501 is almost equal to that of the electron multiplication holes of the last-stage dynode plate 6, and the electron passage holes 501 are arranged in a matrix form. In other words, the electron passage holes are located at a position where the secondary electrons emitted from the electron multiplication holes of the last-stage dynode plate 6 reach. An input opening serving as one end of each electron passage hole is formed in the upper surface (dynode unit 60 side) of the anode plate 5, and an output opening serving as the other end of the corresponding electron passage hole is formed in the lower surface (inverting dynode plate 13 side) of the anode plate 5. Each electron passage hole is enlarged toward the output opening such that the output opening has a larger diameter than that of the input opening. That is, each electron passage hole has a partially notched output opening in the plate such that the secondary electrons obliquely incident on the anode plate 5 can pass with a high efficiency without collision. For this reason, the capture area for the secondary electrons orbit-inverted by the dynode plates 13 is increased. The anode plate 5 is set at the highest potential even in comparison to that of each dynode plate 6. For example, the anode plate 5 is set at 1,000 V. The potential of the anode plate 5 is set higher than that of the inverting dynode plate 13, so that the secondary electrons orbit-inverted from the inverting dynode plate 13 to the anode plate 5 can be captured by the anodes of the anode plate 5.

A plurality of through holes 100 extending through the dynode plate 13 in the direction of thickness are formed by etching or the like. The arrangement pitch of these through holes 100 is almost equal to that of the electron multiplication holes of the last-stage dynode plate 6, and the through holes 100 are arranged in a matrix form. Each electron passage hole is formed between a plurality of positions (positions opposing the respective anodes) where the secondary electrons emitted from the electron passage holes 501 of the anode plate 5 reach. These positions change depending on a distance between the anode plate 5 and the inverting dynode plate 13. For example, such a position is located immediately below the electron multiplication hole (dynode 603) of the last-stage dynode plate 6. An input opening serving as one end of each through hole is formed in the upper surface (anode plate 5 side) of this plate, and an output opening serving as the other end of the corresponding through hole is formed in the lower surface (metal base 4 side). The input opening has a size almost equal to that of the output opening. The inverting dynode plate 13 is set at a potential lower than that of the anode plate 5. For example, the inverting dynode plate 13 is set at 900 V. Therefore, the secondary electrons passing through the electron passage holes 501 of the anode plate 5 are orbit-inverted from the inverting dynode plate 13 to the anode plate 5.

With the above structure, the plurality of through holes 100 are formed in the inverting dynode plate 13 in a matrix form at a pitch almost equal to that of the electron multiplication holes (dynodes 603) of the last-stage dynode plate 6 of the dynode unit 60. For this reason, when an alkali metal vapor 17 is introduced in the vacuum container, it passes through the through holes 100 of the inverting dynode plate 13, the electron passage holes 501 of the anode plate 5, the electron multiplication holes (dynodes 603) of each dynode plate 6 of the dynode unit 60, and the through holes (focusing electrodes 8) of the focusing plate 7 from the bottom portion of the vacuum container. The metal vapor is deposited to an almost uniform thickness from the center portions to the peripheral portions on the respective surfaces of each dynode 603 and the photocathode 3. As a result, upon incidence of light, photoelectrons can be generated on the photoelectric surface of the photocathode 3 at all the positions thereof at almost uniform reactivity. Upon incidence of the electrons, the secondary electrons are emitted from the secondary electron emitting layer of each dynode 003 at almost all positions thereof at almost uniform reactivity. Therefore, an output signal obtained upon capturing these secondary electrons has an almost uniform sensitivity at all positions of the photocathode upon reception of the incident light.

The plurality of electron passage holes 501 are formed in the anode plate 5 at a position where the secondary electrons emitted from the last-stage dynode plate 6 of the dynode unit 60 reach. The electron passage holes 501 are formed in a matrix form at a pitch almost equal to that of the electron multiplication holes (dynodes 603) of the last-stage dynode plate 0. The plurality of through holes 100 are formed at a plurality of positions (positions opposing the respective anodes) where the secondary electrons emitted from the anode plate 5 reach. The through holes 100 are formed in a matrix form at a pitch almost equal to that of the electron multiplication holes of the last-stage dynode plate 6. For this reason, the secondary electrons emitted from each last-stage dynode 603 can pass through the electron passage hole 501 of the anode plate 5 at a high efficiency. The secondary electrons are then orbit-inverted to the anode plate 5 by the inverting dynode plate 13. The anode plate 5 has a large exposure area with respect to each last-stage dynode 603 and the inverting dynode plate. The output pore of each electron passage hole 501 of the anode plate 5 which opposes the inverting dynode plate 13 has a larger diameter than that of the input port thereof (opposing the last-stage dynode plate 6). For this reason, the field intensity at the anode plate 5 is increased to decrease the space charge in each electron passage hole 501. Since the exposure area of the anode plate 5 for the secondary electrons orbit-inverted by the inverting dynode plate 13 is increased, the secondary electrons captured by each anode of the anode plate 13 can be increased. The secondary electrons emitted from the last-stage dynode plate 6 of the dynode unit 60 and the inverting dynode plate 13 are captured by each anode of the anode plate 5 at a high efficiency, thereby obtaining an output pulse proportional to the energy of the incident light.

The present invention is not limited to the particular embodiments described above, and various changes and modifications can be made within the spirit and scope of the invention.

For example, in each embodiment described above, the hermetic glass 15 is tapered. However, when a working voltage is low, the hermetic glass may have a flat surface, or the diameter of the hermetic glass may De increased.

The anode used in each embodiment described above may be replaced with a multi-anode mounted in a rectangular mounting hole formed extending through the metal base 4. In this case, output signals are extracted from a large number of anode pins arranged in a matrix form and vertically extending on the multi-anode, thereby detecting positions.

In each embodiment described above, a plurality of connecting pins 11 vertically extend through the metal base 4 via tapered hermetic glass 15 and are arranged in a rectangular shape. Large disk-like tapered hermetic glass 15 may be mounted in a circular mounting hole formed extending through the metal base 4, and a plurality of connecting pins 11 may directly extend therethrough at its peripheral portion, thereby reducing the number of components and cost.

As has been described above, according to the present invention, an inverting dynode plate has through holes arranged in a matrix form at a pitch equal to that of the electron multiplication holes. For this reason, an alkali metal vapor introduced from the bottom portion of a vacuum container passes through the through holes of the inverting dynode plate, the electron passage holes of an anode plate, the electron multiplication holes of each dynode plate, and the through holes (focusing electrodes) of a focusing electrode plate. The metal vapor is then uniformly deposited from the central portions to the peripheral portions of the respective surfaces of each dynode plate and the photocathode. As a result, photoelectrons and secondary electrons can be generated and emitted at almost all positions of the photocathode and each dynode plate at almost uniform reactivity. Sensitivity variations depending on the photocathode positions on which light is incident can be reduced.

According to the present invention, the anode plate has electron passage holes at positions where the secondary electrons emitted from the dynode unit reach. The inverting dynode plate has through holes (metal vapor inlet holes) between a plurality of positions (positions opposing the respective anodes) at which the secondary electrons passing through the anode plate reach. For this reason, the secondary electrons emitted from the last-stage dynode plate pass through the electron passage holes of the anode plate at a high efficiency and are orbit-inverted to the anode plate by the inverting dynode plate. The anode plate has a larger exposure area with respect to the last-stage dynode plate and the inverting dynode plate. In addition, each electron passage hole of the anode plate has an output opening opposing the inverting dynode plate and having a larger diameter than that of its input opening. For this reason, the field intensity at the anode plate is increased to decrease the space charge at the electron passage hole. Since the anode exposure area for the secondary electrons orbit-inverted by the inverting dynode plate is increased, the secondary electrons captured by each anode can be increased. As a result, the cascade-multiplied secondary electrons can be captured by each anode at a high efficiency, and therefore an output pulse proportional to the energy of incident light can be obtained.

The sensitivity variations depending on the photocathode positions on which light is incident can be minimized, thereby providing a photomultiplier capable of obtaining an output signal proportional to the energy of light.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. An electron multiplier comprising:

a dynode unit constituted by stacking a plurality of stages of dynodes, spaced apart from each other at predetermined intervals;

an inverting dynode plate; and an anode plate being arranged between said dynode unit and said inverting dynode plate, said anode plate having an electron through hole for causing the secondary electrons emitted from said dynode unit to pass therethrough, said electron through hole having a secondary electron exit side whose diameter is larger than that of a secondary electron incident side thereof.

2. An electron multiplier comprising:

a dynode unit constituted by stacking a plurality of stages of dynode plates, said dynode plates spaced apart from each other at predetermined intervals through insulating members in an incident direction of electrons, each said dynode plate supporting at least one dynode for cascade-multiplying the incident electrons;

an anode plate, provided to oppose parallel to a last-stage dynode plate of said dynode unit through a first insulating member, for supporting at least one anode, said anode plate having an electron through hole, formed at a position where secondary electrons emitted from said last-stage dynode plate reach, for causing the secondary electrons to pass therethrough, and said electron through hole having a secondary electron exit side whose diameter is larger than that of a secondary electron incident side thereof; and an inverting dynode plate for supporting at least one inverting dynode for inverting orbits of the secondary electrons passing through said anode plate toward said anode, said inverting dynode plate being arranged to oppose in parallel to said anode plate through a second insulating member such that said anode plate is sandwiched between said last-stage dynode plate of said dynode unit and said inverting dynode plate.

3. A multiplier according to claim 2, wherein said inverting dynode plate has a plurality of through holes for injecting a metal vapor to form at least a secondary electron emitting layer on a surface of an each-stage dynode of said dynode unit.

4. A multiplier according to claim 2, wherein the electron through hole of said anode plate has an inner surface opposing to parallel to said inverting dynode plate.

5. A multiplier according to claim 2, wherein said anode plate supports a plurality of anodes and has through holes through which the secondary electrons emitted from said last-stage dynode plate of said dynode unit pass between said anodes, and said inverting dynode plate has a plurality of through holes for injecting a metal vapor to form at Least a secondary electron emitting layer on a surface of an each-stage dynode of said dynode unit, said through holes respectively being arranged at positions opposing said anodes.

6. A multiplier according to claim 2, wherein said anode plate has an engaging member engaged with a corresponding one of connecting pins for applying a desired voltage at a predetermined position of a side surface thereof, said side surface in parallel to the incident direction of said electrons.

7. A multiplier according to claim 6, wherein said engaging member is constituted by a pair of guide pieces for guiding the corresponding connecting pin.

8. A multiplier according to claim 6, wherein said inverting dynode plate has an engaging member, at a position of a side thereof in parallel to the incident direction of said electrons, for engaging with one of connecting pins for applying a desired voltage, so that an arrangement position of said engaging member formed at said side surface of said inverting dynode plate and an arrangement position of said engaging member formed at said side surface of said anode plate do not cause said engaging members to overlap each other with respect to the electron incident direction.

9. A multiplier according to claim 2, further comprising a shield electrode plate for supporting an least one shield electrode for inverting orbits of the secondary electrons passing through said anode plate toward said anode, said shield electrode plate having a plurality of through holes for injecting the metal vapor to form at least said secondary electron emitting layer on a surface of at least each-stage dynode of said dynode unit, and said shield electrode plate being arranged to oppose parallel to said inverting dynode plate through a third insulating member such that said inverting dynode plate is sandwiched between said anode plate and said shield electrode plate.

10. A photomultiplier comprising:

a photocathode;

a dynode unit constituted by stacking a plurality of stages of dynode plates, said dynode plates spaced apart from each other at predetermined intervals through insulating members in an incident direction of photoelectrons emitted from said photocathode, each said dynode plate supporting at least one dynode for cascade-multiplying the incident photoelectrons;

an anode plate, provided to oppose parallel to a last-stage dynode plate of said dynode unit through a first insulating member, for supporting at least one anode, said anode plate having an electron through hole, formed at a position where secondary electrons emitted from said last-stage dynode plate reach, for causing the secondary electrons to pass therethrough, and said electron through hole having a secondary electron exit side whose diameter is larger than that of a secondary electron incident side thereof; and an inverting dynode plate for supporting at least one inverting dynode for inverting orbits of the secondary electrons passing through said anode plate toward said anode, said inverting dynode plate being arranged to oppose in parallel to said anode plate through a second insulating member such that said anode plate is sandwiched between said last-stage dynode plate of said dynode unit and said inverting dynode plate.

11. A photomultiplier according to claim 10, wherein said inverting dynode plate has a plurality of through holes for injecting a metal vapor to form at least a secondary electron emitting layer on a surface of an each-stage dynode of said dynode unit.

12. A photomultiplier according to claim 10, wherein the electron through hole of said anode plate has an inner surface opposing to parallel to said inverting dynode plate.

13. A photomultiplier according to claim 10, wherein said anode plate supports a plurality of anodes and has through holes through which the secondary electrons emitted from said last-stage dynode plate of said dynode unit pass between said anodes, and said inverting dynode plate has a plurality of through holes for injecting a metal vapor to form at least a secondary electron emitting layer on a surface of an each-stage dynode of said dynode unit, said through holes respectively being arranged at positions opposing said anodes.

14. A photomultiplier according to claim 10, wherein said anode plate has an engaging member engaged with a corresponding one of connecting pins for applying a desired voltage at a predetermined position of a side surface thereof, said side surface in parallel to the incident direction of said photoelectrons.

15. A photomultiplier according to claim 14, wherein said engaging member is constituted by a pair of guide pieces for guiding the corresponding connecting pin.

16. A photomultiplier according to claim 14, wherein said inverting dynode plate has an engaging member, at a position of a side surface thereof in parallel to the incident direction of said photoelectrons, for engaging with one of connecting pins for applying a desired voltage, so that an arrangement position of said engaging member formed at said side surface of said inverting dynode plate and an arrangement position of said engaging member formed at said side surface of said anode plate do not cause said engaging members to overlap with respect to the photoelectron incident direction.

17. A photomultiplier according to claim 10, further comprising a shield electrode plate for supporting at least one shield electrode for inverting orbits of the secondary electrons passing through said anode plate toward said anode, said shield electrode plate having a plurality of through holes for injecting the metal vapor to form at least said secondary electron emitting layer on a surface of at least each-stage dynode of said dynode unit, and said shield electrode plate being arranged to oppose parallel to said inverting dynode plate through a third insulating member such that said inverting dynode plate is sandwiched between said anode plate and said shield electrode plate.

18. A photomultiplier according to claim 10, further comprising a focusing electrode plate, formed between said photocathode and said dynode unit, for supporting at least one focusing electrode for correcting orbits of the photoelectrons emitted from said photocathode, said focusing electrode plate being fixed on a photoelectron incident side of said dynode unit through an insulating member.

19. A photomultiplier comprising:

a housing for fabricating a vacuum container, said housing having a light receiving plate;

a photocathode deposited on a surface of said light receiving plate in said housing;

a dynode unit having a plurality of stages of dynode plate stacked in an incident direction of photoelectrons emitted from said photocathode, said dynode plates spaced apart from each other at predetermined intervals through insulating members such that a first-stage dynode plate of said dynode unit opposes in parallel to said photocathode, each said dynode plate supporting at least one dynode for cascade-multiplying the photoelectrons;

a base member integrally formed with said housing to constitute said vacuum container such that said dynode unit is mounted on said base member in said housing, said base member guiding a plurality of connecting pins for applying a predetermined voltage to said dynode plates for constituting said dynode unit;

an anode plate for supporting at least one anode, said anode plate being arranged between a last-stage dynode plate and said base member to oppose parallel to said last-stage dynode plate of said dynode unit through a first insulating member, said anode plate having an electron through hole, formed at a position where secondary electrons emitted from said last-stage dynode plate reach, for causing the secondary electrons to pass therethrough, and said electron through hole having a secondary electron exit side whose diameter is larger than that of a secondary electron incident side thereof; and an inverting dynode plate for supporting at least one inverting dynode for inverting orbits of the secondary electrons, passing through said anode plate, toward said anode, said inverting dynode plate being arranged to oppose parallel to said anode plate through said anode plate and a second insulating member such that said anode plate is sandwiched between said anode plate and said base member.

20. A photomultiplier according to claim 19, wherein said inverting dynode plate has a plurality of through holes for injecting the metal vapor to form at least a secondary electron emitting layer on a surface of an each-stage dynode of said dynode unit.

21. A photomultiplier according to claim 19, wherein the electron through hole of said anode plate has an inner surface opposing to parallel to said inverting dynode plate.

22. A photomultiplier according to claim 19, wherein said anode plate supports a plurality of anodes and has through holes through which the secondary electrons emitted from said last-stage dynode plate of said dynode unit pass between said anodes, and said inverting dynode plate has a plurality of through holes for injecting the metal vapor to form at least a secondary electron emitting layer on a surface of an each-stage dynode of said dynode unit, said through holes respectively being arranged at positions opposing said anodes.

23. A photomultiplier according to claim 19, wherein said anode plate has an engaging member engaged with a corresponding one of connecting pins for applying a desired voltage at a predetermined position of a side surface thereof, said side surface in parallel to the incident direction of said photoelectrons.

24. A photomultiplier according to claim 23, wherein said engaging member is constituted by a pair of guide pieces for guiding the corresponding connecting pin.

25. A photomultiplier according to claim 23, wherein said inverting dynode plate has an engaging member, at a position of a side surface thereof in parallel to the incident direction of said photoelectrons, for engaging with one of connecting pins for applying a desired voltage, so that an arrangement position of said engaging member formed at said side surface of said inverting dynode plate and an arrangement position of said engaging member formed at said side surface of said anode plate do not cause said engaging members to overlap each other with respect to the electron incident direction.

26. A photomultiplier according to claim 19, further comprising a shield electrode plate for supporting at least one shield electrode for inverting orbits of the secondary electrons passing through said anode plate toward said anode, said shield electrode plate having a plurality of through holes for injecting the metal vapor to form at least said secondary electron emitting layer on a surface of at least each-stage dynode of said dynode unit, and said shield electrode plate being arranged to oppose parallel to said inverting dynode plate through a third insulating member such that said inverting dynode plate is sandwiched between said anode plate and said shield electrode plate.

27. A photomultiplier according to claim 26, wherein said shield electrode plate serving as part of said base member, said part of said base member being an area opposing parallel to said inverting dynode plate.

28. A photomultiplier according to claim 19, further comprising a focusing electrode plate, formed between said photocathode and said dynode unit, for supporting at least one focusing electrode for correcting an orbit of the photoelectron emitted from said photocathode, said focusing electrode plate being fixed on a photoelectron incident side of said dynode unit through an insulating member.

* * * * *